US005958548A

United States Patent [19]

Negola et al.

[11] Patent Number: 5,958,548

[45] **Date of Patent: *Sep. 28, 1999**

[54] CARPET TUFTED WITH BULKED CONTINUOUS FILAMENT CARPET FACE YARNS UTILIZING NEW SHEATHED CORE FILAMENTS AND RELATED SELECTION TECHNIQUES TO PRODUCE COST SAVINGS

[75] Inventors: Edward J. Negola, Roswell; James R. Kennedy, Smyrna, both of Ga.

[73] Assignee: Nyltec Inc., Atlanta, Ga.

[ * ] Notice: This patent issued on a continued prosecution application filed under 37 CFR 1.53(d), and is subject to the twenty year patent term provisions of 35 U.S.C. 154(a)(2).
This patent is subject to a terminal disclaimer.

[21] Appl. No.: 08/693,939

[22] Filed: Aug. 14, 1996

[51] Int. Cl.[6] ..... B32B 3/02; D02G 3/00

[52] U.S. Cl. ..... 428/92; 428/95; 428/373; 428/372

[58] Field of Search ..... 428/85, 92, 97, 428/373, 372, 374, 95

[56] References Cited

U.S. PATENT DOCUMENTS

| | | | |
|---|---|---|---|
| 3,788,940 | 1/1974 | Ogata et al. . | |
| 4,374,641 | 2/1983 | Burlone | 8/557 |
| 4,460,649 | 7/1984 | Park et al. . | |
| 4,579,762 | 4/1986 | Ucci | 428/95 |
| 5,294,488 | 3/1994 | Butler et al. | 428/373 |
| 5,549,957 | 8/1996 | Negola et al. | 428/373 |

FOREIGN PATENT DOCUMENTS

| | | |
|---|---|---|
| 842115 | 5/1970 | Canada . |
| 852100 | 9/1970 | Canada . |
| 890988 | 1/1972 | Canada . |
| 1085122 | 9/1980 | Canada . |
| 1137265 | 12/1982 | Canada . |
| 1172815 | 8/1984 | Canada . |
| 373655 | 6/1990 | European Pat. Off. . |
| 421971 | 4/1991 | European Pat. Off. . |

*Primary Examiner*—William Krynski
*Assistant Examiner*—J. M. Gray
*Attorney, Agent, or Firm*—Schweitzer Cornman Gross & Bondell LLP

[57] ABSTRACT

A carpet is constructed of a face yarn comprised principally of a bulked continuous filament carpet face yarn or a bulk staple carpet face yarn wherein the face yarn comprises principally a bundle of drawn and crimped bi-component filaments, and wherein each such filament consists essentially of an outer lengthwise sheath of a dyeable polymeric material surrounding a core of a different polymeric material, and wherein the two polymeric materials are not dyeable by the same method. A particularly advantageous filament structure comprises a nylon sheath surrounding a polyester core. The nylon sheath may be dyed or pigmented. For automotive and similar usage, a polyester sheath surrounding a core of, for example, polyethylene, may be preferred.

6 Claims, No Drawings

CARPET TUFTED WITH BULKED CONTINUOUS FILAMENT CARPET FACE YARNS UTILIZING NEW SHEATHED CORE FILAMENTS AND RELATED SELECTION TECHNIQUES TO PRODUCE COST SAVINGS

FIELD OF THE INVENTION

This invention relates generally to carpet manufactured using bicomponent carpet yarns. More particularly, this invention relates to carpet manufactured using bicomponent carpet fibers having a linear sheath of one material and a core of another material. This invention discloses a method of selecting and dyeing the appropriate raw materials to produce an economical carpet substitute for homopolymer residential and commercial carpet.

BACKGROUND OF THE INVENTION

A carpet manufacturer selects a specific market or end use for the carpets that he will manufacture before selection of a method of manufacture (machine), raw materials to be used (yarn, backing, dyeing, finishing and secondary backing).

There are three distinct end uses for carpets:

1. Residential
2. Commercial or Industrial
3. Specialty Uses such as marine, automotive, acoustic etc.

Each end use requires raw materials made up specifically for that use. For example, a thick luxurious carpet pile is very desirable in a residential living area but it would not last very long in an office or a high traffic restaurant. The method of manufacture and the materials used must match the end use.

Residential Carpet:

There are three basic types of Residences that use residential carpets: (a) Private Individual Home, (b) Apartment dwellings, (c) Modular or mobile homes.

Most residential carpet (comprising 68% of the total market) is made using nylon yarns for the face or pile that are curled by the Bulked Continuous Filament process or by a Crimping Process that imparts wool-like curls to the yarn. The carpet is usually colored after by being piece dyed in a beck or on a continuous dye process range. This type of carpet is dyed to brilliant shades to match popular decors found in the home. Living room and bedroom carpeting is usually a thick cut pile type of carpet whereas the remainder e.g. the playroom, den and basement is usually carpeted using a loop pile. Thickness of pile varies with the income level of the purchaser but in general, expensive homes use thick pile carpets of nylon in solid shades, while mobile homes and apartments use a thinner pile carpet and will use multi-color cut pile or loop piles. 98% of all residential carpets are manufactured using tufted methods and synthetic carpet yarn in the face. The primary and secondary backing is manufactured using synthetic woven polypropylene. In addition, carpets that are woven or manufactured using a needlebonded process are also used as residential carpets. Needlebonded carpets use crimped staple carpet fibers that have been manufactured by cutting many strands of crimped continuous filaments into lengths that vary from 2.5 inches to 7.5 inches.

Most residential carpet is now manufactured by multiple manufacturers using similar raw materials and methods. There is very little that differentiates one manufacturer's carpet from another. Cost and pricing is the driving force that enables one manufacturer to gain market share over another. Economies of scale have reduced the manufacturing costs to a level that is almost equal among manufacturers. The only way to achieve a cost advantage would be to select a face yarn that would create the look and feel of present day carpets yet cost less to manufacture. A manufacturer that uses a new cost savings material in the face of the carpet would have a distinct advantage.

Commercial Carpet:

Commercial carpet is used in buildings that are not considered residential in nature. Offices, Halls, Medical Facilities, Restaurants, Hotels, Schools and the like fall into this category. Aircraft, automobiles, recreational vehicles and boats are another important commercial category.

Carpet Used in Commercial Buildings:

Commercial carpet in buildings is characterized by a very dense construction and is usually made in a level loop pile. Approximately 98% of the commercial carpet in the United States is tufted. Woven and Needlebonded carpets are also used as commercial carpets. The face yarn of commercial carpet is usually pre-colored before it is tufted or woven into carpets. The pre-colored yarns are usually blended or twisted together to create a multi-colored or heather type of yarn. Pre-colored yarn using a pigmented dye method is more color fast and fade resistant than carpet colored by the piece dye system. However a growing segment of the commercial market is in print carpet. Commercial carpets made using nylon face carpet yarns are printed on a large scale printing machine to create patterns that resemble more expensive Axminster woven styles.

Nylon and polypropylene are used in 97.7% of all commercial carpeting. The same economics that influence residential market cost and pricing also influences the commercial markets. A manufacturer that can save on raw materials in the carpet face yarn will have a great advantage.

It will be shown herein that by using the concepts of the present invention, a manufacturer can create carpets to suit either a residential or commercial application and obtain a substantial cost advantage by using face yarns that look and perform like nylon or pre-colored carpet face yarns yet cost less to manufacture. These new carpets can be processed on nylon carpet dyeing and processing equipment without modification.

The present invention relates primarily to a new bulked (textured) continuous filament dyeable carpet face yarn that utilizes a sheath-core melt spinning process. This carpet yarn is a multi filament yarn comprised of a plurality of individual uniformly sheath-cored filaments having a dyeable sheath of virgin Nylon and a carpet grade polymer core that cannot be dyed using standard nylon dye atmospheric pressure dyeing methods. This yarn is a less expensive substitute for 100% Nylon carpet face yarn.

The bicomponent filament yarn of present invention finds its principal application in the tufted carpet industry which utilizes undyed yarns as face yarns to create tufted carpet greige goods. In the manufacture of tufted carpeting, the face yarns used in the process, account for at least 68% of the cost of the finished product. Another significant cost when manufacturing carpet is the dyeing of the carpet. Dyeing nylon carpet is usually achieved by a standard atmospheric dyeing process. In this dyeing process, the carpet is subjected to a bath which contains dyes, chemicals and water at elevated temperatures. The dye attaches chemically to the nylon yarn dye sites and the result is a desirable color shade. Face yarn constitutes the major portion of carpet manufacturing expense while the dyeing of the carpet is the next most expensive manufacturing step.

There are two common types of synthetic dyeable carpet face yarn available to the tufted carpet industry, polyester and Nylon. The Nylon yarns are dyeable at standard atmospheric pressure. Polyester is dyeable by using expensive pressure vessels and harsh chemical carriers. Polyester has no dye sites and therefore is uhdyeable using the nylon acid dye system. The tufted carpet industry uses 90% Nylon as face yarns to manufacture carpet dyeable at atmospheric pressure. Nylon yarn is dyeable because dye sites are present in its manufacture. These dye sites are receptive to the most common acid dyes used in the tufted carpet industry. Nylon yarns are called by the generic trade name, Nylon. There are two common trade names for nylon, nylon 6 or nylon 6/6. Both are dyeable using standard atmospheric pressure in concert with acid dyes. They are well known to those skilled in the art.

As Reader says in U.S. Pat. No. 4,406,310, "Since carpets must be both functional and aesthetic the characteristics of the face yarns inserted into the fabric and the ability to apply desired colors to such yarns and tufted carpets and the tufting design are very important in determining marketability of the final carpets." In addition to ease of dyeing, carpeting must withstand repeated stress under various traffic pressure. Because Nylon stands up to heavy traffic and its ease of dyeing, it is the yarn of choice in the tufted carpet industry. Nylon is the primary raw material for approximately 68% (1.9 billion pounds) of the total synthetic tufted carpet industry.

Synthetic fibers and yarns are based on the petrochemical industry. The chemicals necessary to manufacturer Nylon are a product of the oil refining process and increase in price in direct proportion to the price of oil. Nylon is only available from a limited number of large manufacturers. This limited number of suppliers is due to the capital intensive equipment required to polymerize nylon. Although it would be obviously desirable to use a less expensive substitute for carpet nylon, the solution to this problem has been difficult to achieve.

Specifically, to qualify as a nylon substitute face yarn in the tufted carpet industry, the yarn must have the following characteristics:

1. superior recovery from crushing or compression
2. the ability to be tufted at high speeds
3. the ability to apply desired color on conventional dyeing equipment at atmospheric pressure
4. strength to resist heavy foot traffic
5. a good bulking characteristic to give coverage without using too much material (texturing potential)

No other synthetic carpet material except nylon possesses all the above named five desired qualities.

The manufacturer of tufted nylon carpet can also achieve many desirable color effects from undyed greige goods. For example, nylon carpet can be dyed into many different shades of solid colors, printed with floral or geometric designs, or sprayed with computer assisted equipment for tonal effects. When using nylon other special effects can be achieved in the dyeing and treatment of the yarn. This includes the application of stain repellents, anti-microbial and multi-colored space dyeing.

Sheath-core techniques using different polymers and cross sections are well known to produce yarn characteristics which may be desirable for specific applications such as tire treads, seat belts, apparel, etc. but which are entirely unsuitable for carpet manufacture and in particular, the manufacture of bulked continuous filament carpet yarn or crimped staple carpet fibers.

The following are some examples:

The Matsui U.S. Pat. No. 3,700,544 teaches improved filament flexural rigidity due to appropriate non-circular shapes given to the core. Matsui's examples all specify quenching the drawn filaments in 100 centigrade water for between ten and fifteen minutes. Such conditions are impractical for the commercial production of carpet yarn.

Lin Fa Lee U.S. Pat. No. 3,992,499 shows that it is possible to extrude two filaments of differing dyeability using a sheath core system of feeding two molten polymers to a special spinneret. The patent teaches how to dye heather effects for apparel by varying the amount of polymer having differing dye receptors. The yarn sizes in each example limit its use to apparel applications and does not teach any practical carpet yarn applications to one skilled in the art.

Hull U.S. Pat. No. 3,803,453 teaches that a polyethylene sheath with a core of carbon can be co-extruded with nylon to create a synthetic filament having electrically conductive properties to eliminate static. However, the construction of this filament limits its use to that of an additive to a carpet face yarn. It cannot physically function as a carpet face yarn, in particular as a bulked face yarn.

van Leeuwen et al. U.S. Pat. No. 4,473,617 teaches a bicomponent multi filament that has a pigmented core and an outer sheath of nylon having a high tenacity suitable for use in seat belts, fishing nets and ropes. The outer nylon sheath protects manufacturing equipment for seat belts, nets and rope from abrasive additives to the core. This invention has no applicability to the manufacture of bulked continuous filament carpet face yarn since the abrasive additives in the core prohibit texturization of these filaments.

Saito et al. U.S. Pat. No. 4,987,030 teaches that by melt spinning a bicomponent sheath core process using a high intrinsic viscosity polyethylene terephthalate core and a Nylon sheath composed mainly of polyhexamethylene adipamide (Nylon 6/6) it is possible to produce a superior tire cord yarn that has excellent adhesion to rubber. The specifications call for a core material using a high IV of preferably 0.90 and yielding a high tenacity conjugated fiber. The high intrinsic viscosity raw material which Saito uses is much too expensive to be used in the manufacture of carpet yarn. The high tenacity requirement for tire cord yarn is not required for a carpet face yarn.

Schipper et al. U.S. Pat. No. 4,019,311, uses the principles of bicomponent sheath-core and side by side extrusion. The concept clearly states that a stretch ratio of 1:1.25 to 1:2.5 be maintained in order to achieve the desired results. The invention uses the second stage of stretching to break filaments causing them to twist around the other dissimilar filaments thus producing a yarn that feels as if it were mechanically spun from staple tow. Schipper relies on using two filaments that have different stretch potentials. One filament is fully stretched and breaks when drawn further in a second step while the other does not break and is used as a vehicle to carry the broken filaments. This is shown clearly in FIG. 4 where an edge roller is used to draw stretch and break some filaments. While this concept may be useful in the apparel and sweater trade, the weakness of the yarns produced using this method would prohibit them from being used as a carpet yarn.

While teaching specific sheath-core technology techniques the forgoing patents do not address the characteristics necessary for the manufacture of a dyeable carpet face yarn. More specifically, both cost and performance characteristics of each of the above prohibit teaching or suggesting use as commercial carpet yarns.

SUMMARY OF THE INVENTION

The present invention relates to synthetic bicomponent multi filament carpet face yarns and carpets made of such face yarns which have unique and surprising characteristics.

One of the principal bicomponent multi filament face yarns disclosed herein utilizes Nylon as an outer sheath and a carpet grade polymeric core such as Polyester, Polyethylene Terephthalate (PET), Polytrimethylene Terephthalate (PTT), Polypropylene, Olefin or Polyvinyl Chloride which will not dye using nylon dyes at standard atmospheric pressure when the nylon sheath is dyed using standard nylon acid dye techniques. Carpet grade polymer refers to any polymer that is fiber forming and can be texturized by the BCF method or by the bulk crimping method when making staple tow.

A preferred embodiment is to use yarn that is texturized using the BCF texturing method intended to impart a crimp or curl well known to those skilled in the art of carpet yarn manufacture. The percentage of nylon in the sheath of each filament by weight shall preferably be at least twenty percent but under certain conditions which shall be explained herein, may be only ten percent. A preferred percentage will be a 30% nylon sheath and a 70% core.

APPLICATION OF THE PRESENT INVENTION TO SPECIFIC GRAVITY OF FILAMENT COMPOSITION

Nylon is the most popular synthetic carpet fiber on the market for almost any end use except extremely inexpensive carpet. The sheath-core carpet of the present invention is in appearance and in all other respects very similar to 100% Nylon carpet; however, the calculated specific gravity or weight of the sheath-core carpet is approximately 15% less than 100% Nylon carpet. This difference in carpet weight for the same pile height and stitch rate is due to the differing specific gravity of the separate polymers.

Each polymer has a unique specific gravity that is a measure of volume displacement. Sheath-core carpet specific gravity is determined by multiplying the individual polymer specific gravities by their percentage use and averaging the results. Using sheath-core carpet fiber allows changing the total specific gravity by changing the polymers and their percentage use in each filament.

Table 1 shows the specific gravity of the three most common carpet fibers and two examples of the specific gravity of sheath-core carpet fibers. A relationship was discovered between 100% Nylon specific gravity and the sheath-core specific gravity that beneficially assists in the selection and construction of sheath-core core carpet as a substitute for 100% Nylon. For residential use a sheath-core specific gravity less than Nylon is desirable and for commercial use a sheath-core specific gravity greater than Nylon is desirable. This method is specifically for use as a Nylon substitute because it is not feasible to obtain a specific gravity higher than 100% PET or lower than 100% polypropylene.

TABLE 1

| Specific Gravity Combinations | Sheath Specific Gravity | Core Specific Gravity | Total Specific Gravity |
|---|---|---|---|
| Nylon | | | 1.14 |
| PET | | | 1.35 |
| PTT | | | 1.35 |
| Olefin | | | .90 |
| 30% Nylon<br>70% Olefin | .30 × 1.14 = .342 | .70 × .90 = .63 | .972 |
| 50% Nylon 66<br>50% PET | .50 × 1.14 = .57 | .50 × 1.35 = .675 | 1.245 |

Residential carpet is sold on price and appearance with less emphasis on wearability than commercial carpet. A sheath-core specific gravity less than Nylon permits achieving the same look and feel as Nylon but at a reduced price because a bulkier fiber is being used hence more "hand" is obtained for less weight. Heavy commercial use requires a higher density carpet for wearability and therefore a specific gravity greater than Nylon is desirable. A Residential sheath-core combination with 15% less specific gravity than Nylon was selected and a heavy commercial combination with 9% more specific gravity than Nylon was selected.

As discussed, the selection of sheath-core polymers can be adjusted depending on the end use for the carpet and the desired combined specific gravities of the individual polymers in the sheath and core. Any fiber forming polymer can be used to make sheath-core bulked carpet face yarns. Nylons and their copolymers, polyethylene terephthalates and their copolymers, polyvinyl chlorides and their copolymers, and polyolefins and their copolymers are examples of polymers that can be used in sheath-core carpet face yarn. The sheath is the most critical component and must be a high molecular weight substance with fiber forming properties. The polymer selected for the core is not as critical as that selected for the sheath and can have a lower molecular weight and marginal fiber forming qualities as long as the strength of the sheath is sufficient to overcome the deficiencies in the core.

ADDING HOMOPOLYMER FILAMENTS WHEN EXTRUDING BICOMPONENT SHEATH CORE CARPET YARNS

It is sometimes desirable to include Homopolymer filaments of the sheath or the core material in the yarn bundle of sheath core filaments. These filaments will either dye deeper if for example the nylon used to form the sheath is used as the homopolymer or will not dye at all if the non dyeable core material is used as the homopolymer. A preferred embodiment would be to extrude 25% homopolymers or 15 filaments of 60 filaments while extruding the bundle of sheath core carpet yarn. An ideal arrangement would be to channel a homopolymer filament to every fourth hole of the spinneret during extrusion. This can be varied by one skilled in the art to suit the desirable style of carpet preferred.

The following examples disclose specific carpets that can be made using sheath-core carpet yarn construction and the benefits of sheath-core carpet as previously discussed.

These and other aspects of the invention shall become apparent upon examination of the following specification and claims.

DETAILED DESCRIPTION OF PARTICULAR EMBODIMENTS OF THE INVENTION

A process for producing a multi filament yarn composed of a plurality of filaments melt spun by the sheath core method substantially using marginal material in the core and virgin Nylon 6 or 66 as the sheath that is suitable for use as a dyeable carpet face yarn in the tufted carpet industry. The yarn is processed for carpets using a Bulking method called bulked continuous filament or by a crimping method used in the manufacture of staple carpet fibers. A BCF carpet yarn can be used directly from the extrusion process to manufacture carpet. A bicomponent crimped filament staple must be further processed by spinning into a carpet yarn or using it to create non woven or Needlebonded carpets.

EXAMPLE 1

Flakes of polyethylene terephthalate are obtained from a commercial plastic beverage bottle recycling facility. The flake is prepared from plastic beverage bottles shredded and cleaned according to known standards set forth in Tomazek U.S. Pat. No. 4,728,045 and Hannigan Fernandas, et al. U.S. Pat. No. 4,830,188. The cleaned flake is dried at 250° F. for four hours and is fed to an extruder which will melt the polymer and pass it through a 150 mesh screen that operates on a continuous basis and filters the polymer to remove minute particles of grit, aluminum, charred plastics, and adhesives, glass etc. that has not been removed in the washing process. This material will be pelletized in the same process and collected in Gaylord containers or silos common to the industry. With a specially built cram feeder to supply the extruder, flake can be used to feed a fiber extruder instead of pellets.

This material now has a heat history from the bottle process, the washing process and the re-extrusion process and is considered marginal. The intrinsic viscosity will be in the 0.60 to 0.70 range.

Just prior to extruding in a fiber extruder the pellets are thoroughly dried in a fluid bed drying apparatus to remove 99.50% to 99.99% of all water moisture from the polymers. A temperature range of 250° F.–350° F. is maintained for four hours. This achieves enough crystallization to allow the pellets to be successfully extruded.

This crystallized material is fed directly to a fiber extruder which is attached to a spin pack designed to feed two molten polymers simultaneously to a spinneret.

A second extruder attached to the above spin pack is fed nylon that is thoroughly dry and ideally covered with a nitrogen blanket in the hopper that is feeding the spin pack.

Thus there are two extruders feeding a single spin pack. The polyethylene terephthalate is molten by one extruder and the Nylon is molten by the other. Temperature ranges are adjusted to those well known in the art of fiber extruding.

The spin pack shall be that well known in the art and shall feed spinnerets to create a filament that has a core of polyethylene terephthalate 70% by weight and a sheath of Nylon (nylon 6) which is 30% by weight. This percentage can be varied by varying the polymer volume fed to the spin packs feeding the spinneret. The sheath should not fall below 20% by volume or the resultant yarn will not be suitable for tufted carpet face yarn.

The molten filaments reach a temperature of 290° C. for nylon 6 and 300° C. for polyethylene terephthalate. The molten material will be a sheathed core plurality of filaments with each individual filament being at least 60 denier. In this example there were one hundred and forty four filaments being drawn at 1000 meters per minute. The total bundle was measured to be 9100 denier.

At a second stage of the machine, the 9100 denier 144 filament bundle was passed over godets or heated rollers designed to stretch or draw the filaments to their full potential which is 1:3.5 or 1:4. The resultant size of the continuous filament yarn bundle will be at least 2600 denier and each filament would be 18 denier. Any further elongation will break the filaments and this is not desirable. Drawing the yarn at this speed orients the crystals and makes the yarn strong.

It is extremely important not to break any filaments and to have each and every endless continuous filament as uniform in size as possible. Broken filaments will cause problems in further processing the yarn on other carpet making equipment. To help facilitate the drawing of the yarn, steam at atmospheric pressure was fed into the yarn feed tube. This helps to avoid broken filaments when drawing.

While draw stretching the yarn over godets, the yarn was fed to an air jet nozzle designed to bulk or crimp the yarn filaments. Crimp is accomplished by feeding the yarn slightly faster than when drawing it out. The yarn then is passed over a cooling apparatus and wound onto a tube to form a yarn package on a continuous basis.

The resultant product was a yarn wound on a ten pound cardboard tube composed of a plurality of 144 sheath core continuous filaments that measured at least 18 denier. The core which is 70% of the material by weight, contained substantially washed and melt filtered marginal polyethylene terephthalate that was reclaimed from the post consumer recycled plastic soda bottle waste stream. The sheath comprising 30% by weight of virgin nylon 6 that can be dyed using standard atmosphere pressure nylon dye systems.

The yarn would be described as a bulked endless 2600 denier filament composed of 144 endless sheathed core filaments for use as a face yarn in tufted carpet. Other carpet yarn sizes such as 1000 denier to 3300 denier can be manufactured using the same process. If it is desirable to manufacture a smaller denier sheath core bulked continuous filament, then the above procedures would have to be changed. A yarn made in this fashion could also be cut to staple lengths with added crimp then spun into a yarn using a carpet yarn spinning system. This would be a bicomponent crimped staple carpet yarn.

The resultant yarn is piece dyeable and uses less dye than a 100% nylon yarn. The sheath is the only dyeable material when using acid dyes at standard atmospheric pressure. In this example, the sheath is 30% by weight of the total weight, therefore the yarn will only require 30% of dyestuff and chemicals normally used in the dyeing process.

By sheathing the core with Nylon before texturing the yarn, the invention has achieved something not previously suggested or anticipated. The nylon sheath serves to hold the crimp or texture in the yarn. Without the nylon as a sheath, the texture or crimp could be easily pulled from the yarn making it unfit for use as carpet face yarn. Therefore, the new carpet yarn disclosed herein in effect utilizes the characteristics of nylon as a carpet yarn but at a fraction of the cost of using 100% nylon.

A substantially further reduction in cost is achieved when the core material is manufactured from green or tinted plastic recovered from the post consumer recycling waste stream. This material is not salable at full price to other industries as they require clear undyed or uncolored material for their process. The BCF yarn is manufactured using a continuous process and is ready to be used as a face yarn by the carpet industry without further processing such as spinning or carding.

The yarn was set up on a carpet tufting machine and was tufted into a primary carpet backing at six stitches to the inch on a one quarter gauge sample tufting machine. The pile height was set at approximately one half inch. The resultant carpet sample was piece dyed to a popular shade of light brown and then was backed on a carpet backing range. The carpet appeared normal in every respect.

During the tufting of the carpet nothing unusual was observed. The machine operators saw no difference between the yarn made under this new process or that of regular Nylon (nylon 6) carpet yarn.

A sample of the carpet was submitted for testing to a well known Georgia testing laboratory in Dalton, Ga. The carpet was tested for its ability to withstand and recover from crushing. There is a direct correlation between crush recovery and the ability of the carpet to withstand compression from foot traffic.

Tests for compression and recovery were performed with a load of 35 pounds per square inch maintained for 48 hours. The total product thickness was determined using a Scheifer Compressometer equipped with a one inch diameter presser foot under a force of 0.22 pounds per square inch. Thickness was measured prior to compression and after 48 hours compression time. The load was removed and the thickness was measured immediately and at various intervals as listed below. The test was conducted under standard conditions for testing textiles.

Test Results

| | | Percent of Original | |
|---|---|---|---|
| Total | Time (hours) | Thickness (inches) | Thickness % |
| compression | 0.00 | 0.478 | 100.0 |
| | 48.00 | 0.346 | 72.4 |
| recovery | 24.00 | 0.429 | 89.7 |
| | 48.00 | 0.437 | 91.4 |
| | 72.00 | 0.443 | 92.7 |
| | 96.00 | 0.445 | 93.1 |
| | 120.0 | 0.446 | 93.3 |

The above test results were compared to a sample made from 100% nylon 66 subjected to the same conditions. Tufting was the same and dying and finishing performed under similar conditions resulted in a product very similar to the product made from 100% nylon. The results showed that the carpet made using the invention was similar to comparable tufted carpet made with face yarns using 100% nylon 66.

The invention using a core of marginal materials not dyeable by the nylon dye method and a sheath of nylon 6 produced high quality tufted carpet face yarn using the prescribed procedures as described.

EXAMPLE 2

Using the heretofore prescribed method of extrusion according to the invention, a core of green PET recovered from plastic beverage bottles and processed properly was used to create a sheath core BCF continuous filament carpet face yarn. The continuous filament carpet yarn contained 144 filaments of at least 18 denier each and its overall size was 2600 denier. The resultant undyed yarn appeared as a light green color since the core was visible through the almost clear nylon sheath.

The yarn was tufted on a sample tufting machine creating a level loop pile carpet that was light green in appearance. Part of the sample carpet was then cut to 3 inch×5 inch swatches and subjected to standard nylon laboratory dye baths. Colors were applied using acid dyes in a standard manner using the exhaust method of dying. The samples were exposed to dying at the boil for thirty minutes.

The yarn dyed to depth of shades not expected. They were dyed a light brown to a deep burgundy red shade using the standard methods. None of the samples showed any sign of the green core. The sheath of nylon 6 dyed to a depth of shades that was enough to make the green core invisible to the naked eye.

The same dye formulas were repeated on identical samples using 100% nylon 6 carpet face yarns. The shades achieved had 50 to 70% less depth than the sheath cored face yarn. This experiment shows that the new bulked continuous filament yarn will require less dye stuffs and chemicals when dying carpet made from yarn using the invention. This is due to the fact that the dye is not dispersed throughout the entire cross section of the fiber. The PET sheath core does not attract any of the acid dyes used to dye Nylon and allows all the dye to concentrate on the nylon portion of the carpet yarn.

EXAMPLE 3

A bulked continuous filament sheath core yarn was made according to the above described methods of the invention. The core was a clear PET material processed according to the invention. It was transparent and was recovered from beverage bottles. Nylon 6 was used as sheath material.

The yarn was made into a standard knitted sleeve and printed with a pale green, a pale orange and a pale blue shade using knit-de-knit method of space dyeing. The dye formulas used contained 50% less dyes than those required to achieve the same shade on 100% nylon 6. The resultant yarn was a space dyed yarn that appeared to be the same as a 100% space dyed nylon carpet yarn.

The yarn was then twisted with three ends of untreated yarn made according to the above invention. A separate yarn was created using the space dyed yarn according to the invention and three untreated yarns made from 100% dyeable nylon 6.

Both composite yarns were tufted into separate 36 inch wide by 24 foot long sample carpets. Using a pile height of one half inch and a stitch rate of six stitches per inch on a one quarter gauge tufting machine. The resultant greige goods appeared as a level loop pile carpet with pale orange, pale blue and a pale green overall spotted effect known to the carpet trade as "BERBER" carpet.

Both samples were subjected to the same pale brown dye formulas and dyed simultaneously on a continuous dye range. The samples were dried, backed and inspected.

The carpet made with 100% sheath core face yarn according to the invention dyed to a 50% greater depth of shade than that of the carpet made using a majority of 100% Nylon 6. No special care had to be accorded the new yarn vs the standard carpet nylon.

In the embodiment of the present invention described above, it is clear that the invention provides for the first time a means to create a tufted carpet costing substantially less to manufacture due to the fact that the face yarn costs less to manufacture but behaves substantially the same as carpet manufactured using 100% Nylon.

In addition to costing less to manufacture the carpet face yarns, the carpet manufacturer will save at least 30% to 70% when dyeing or treating the carpet. Since the core of the sheath core yarn is made from a polymer that will not accept acid dyes or any dyes applied at standard atmospheric pressures only the sheath need be dyed to obtain the decorative shades used in the carpet and home furnishings industry.

Another application anticipated by this invention is its use to create automotive carpets. Most automotive carpet is made from bulked continuous filament nylon. Bulked continuous nylon is used because it has strength, bulking coverage, and compression recovery. Most automotive carpet is manufactured using the tufting process and is then subject to high temperatures during the "molding" process. An important characteristic for automotive carpeting is color fastness and stain resistance. It is known that polyester yarns are inherently ultraviolet light stable and ozone gas resistant. Therefore, Polyester yarns would be better qualified as an automotive carpeting raw material. However polyester is not available in bulked continuous filament yarn form for automotive use because polyester has poor crush recovery characteristics. This invention produces a bulked continuous filament yarn that can be used for automotive carpeting because the nylon sheath provides the necessary compression recovery characteristics. The fact that the core can be made of polyester makes a combined automotive carpet yarn with the stain resistance and light fastness of polyester and the crush recovery of nylon. Automotive carpeting would be tufted into greige goods and then dyed. The tufted greige goods must be dyed at substantially above normal atmospheric pressure so that the Nylon and the polyester would dye to a single solid shade. High energy dye stuffs currently used in dyeing polyester would dye the nylon sheath and polyester core into a fade resistant color with the previously mentioned qualities desirable in automotive carpet. However, using this invention would save at least 30% in raw material costs compared to 100% bulked continuous filament nylon. The costs have factored in the higher costs to dye at increased pressure.

EXAMPLE 4

A bulked continuous filament sheath-core carpet yarn was produced by melt spinning a 30% sheath of Nylon 6 (with a Relative Viscosity of 2.7) and a 70% undyed core of polypropylene (melt index of 18) in a one-step process into a BCF carpet yarn. The melt spinning was done using a two extruder setup equipped with a spin beam and spin packs that mix the flow of polymers together to make a sheath-core filament. Each extruder has a similar polymer pump that regulates the flow of polymer through the system by the pump revolutions per minute and consequently determines the sheath-core mix. In order to make a 30/70 sheath to core ratio the core pump was set at 19.29 rpm and the sheath pump was set at 8.27 rpm. Adjusting the sheath-core process for different polymers and different percentage sheath to core combinations is accomplished by increasing or decreasing the extruder melt temperatures and changing the flow rates on the polymer pumps. Once both materials form as fiber the two streams are mixed together to achieve a desired percentage of sheath to core.

The extruder zone temperatures for the Nylon 6 were 260/265/270/275 degrees centigrade and the four extruder zone temperatures for the polypropylene were 201/240/250/260 degrees centigrade. The processing temperature for the Nylon 6 was 273 degrees centigrade and the processing temperature for the polypropylene was 274 degrees centigrade. The polymer pumps were set for a 30% sheath and a 70% core. Once the process is stabilized you examine the cross-section of the fibers under a microscope to ensure good sheathing around each filament. When a circular cross section was used, some slight variation in the size of the individual filaments resulted and a kidney bean shaped core rather than a completely circular core was observed under a microscope. When a trilobal shape was used, a delta cross section with a more uniform sheath was observed. The Nylon sheath and the polypropylene core do not bond together because nylon is a dissimilar material from polypropylene. Microscopic examination revealed that this difference (which was required in order to form the sheath/core relationship) caused voids to appear in the core between the outer sheath of nylon and the polypropylene core; and furthermore some voids or bubbles were caused entirely within the core itself.

However, the sheathing was quite adequate and the voids or bubbles within the polypropylene core actually increased the bulkiness of the total yarn which is an unexpected and beneficial effect. In fact, the overall effect is to produce a more wool-like carpet yarn with the overall beneficial effect expected of 100% nylon. It was also noted that when a round cross section was used, the resultant yarn was soft to the touch even though the individual filaments were 18 denier.

EXAMPLE 5

SCREEN PRINTED PATTERNED CARPET MANUFACTURED USING BICOMPONENT SHEATH-CORE BULKED CONTINUOUS FILAMENT CARPET YARN

BCF composed of a sheath of 30% Nylon and a core that is 70% polypropylene was prepared according to the invention. Any type of Nylon dyeable by the Nylon dye method at atmospheric pressure and any core that will not dye by the Nylon dye method such as PET, Olefin, Vinyl etc. is acceptable. The combination we chose seems to be the most desirable for residential or light commercial type of carpet.

Manufacturing Technique: A tufted carpet comprising single ends of 1350 bicomponent sheath-core Bulked Continuous Filament Carpet yarn threaded through each tufting needle of a $10^{th}$ gauge tufting machine having tufting needles spaced 1/10th of an inch apart and measuring at least 3 ft wide preferably 12 ft wide. The width of the carpet can be adjusted to suit the need.

The carpet thus produced will have a face of dense undyed level loops $1/10^{th}$ of an inch apart with a 1/4 inch pile height and 10 tufts or stitches to the inch running lengthwise. Adjustments can be made according to the required application anticipated.

The carpet thus produced is undyed greige goods. It is rolled and placed on a machine capable of a continuous screen printing carpet using a print paste of Nylon dyes and requisite chemicals.

Print paste prepared in a standard way is applied to the face of the carpet by being pressed through a mesh of fine screens. We chose an eight screen floral pattern for this example. The Nylon sheath of the BCF yarns absorb the dyes by the Nylon dye method at standard atmospheric pressure while the core will not accept the Nylon dyes or chemicals. The carpet is further processed setting the dyes with atmospheric steam and is then rinsed to remove excess dyes dried and rolled. A secondary backing of woven polypropylene was applied on a standard carpet backing machine.

The resultant floral printed pattern carpet looks and feels the same as carpet produced using 100% Nylon Bulked Continuous Filament carpet yarn. Interestingly, a unique noticeable brilliance of color was observed and was due to the fact that color is magnified by the clear undyed core.

There are substantial savings of dye, chemicals, and utilities as only the dye sites contained in the outer 30% Nylon sheath accepts the dye. Previous to this example, only yarns made from 100% Nylon were capable of being dyed using the acid dye print method of nylon dyes applied at atmospheric conditions.

While with above example a sheath of 30% Nylon and a core of 70% polypropylene was constructed, one skilled in the art could vary the sheath to core ratio to achieve desirable results. Cross sections of the yarn would also be modified to suit the end use that one skilled in the art would determine. In addition, any method of making a print carpet for floor covering can be used whether the carpet was woven, tufted or non woven.

EXAMPLE 6

CUT PILE CARPET MANUFACTURED USING BICOMPONENT SHEATH-CORE BULKED CONTINUOUS FILAMENT CARPET YARN

A sheath-core BCF yarn is melt spun using a sheath of 30% Nylon and a core of 70% polypropylene. The yarn is texturized using the bulked continuous filament (BCF) carpet yarn crimping process as described in the invention. The finished BCF carpet yarn is 1350 denier in size with each filament being 18.75 denier. There are 72 filaments to the bundle.

The undyed carpet yarn thus produced is placed on a carpet yarn twisting machine that will twist each single end of yarn and ply these ends of yarn with six turns to the inch. The twisted yarn is heat set using a Superba heat setting machine. The resultant yarn is a twisted and heat set bicomponent sheath-core Bulked Continuous Filament carpet yarn that can be tufted using a $\frac{1}{8}^{th}$ gauge cut pile tufting machine.

The undyed bicomponent BCF carpet yarn is tufted on an $\frac{1}{8}^{th}$ gauge machine that has 1152 tufting needles across a 12 foot width. The width will vary depending on the end use as tufting machines are available in units of varying widths. A placement of eight stitches to the inch in the length of carpet and a pile height of $\frac{3}{4}^{th}$ of an inch results in a plush pile carpet greige goods that is ready for dyeing by the Nylon dye bath method. The cut pile carpet weighs about 32 oz. per square yard.

The resultant roll of carpet is placed on a continuous dye range and the color recipe is mixed to acid dye only the sheath portion of the yarn used in the manufacture of this carpet. We chose a sheath of 30% Nylon and a core of 70% polypropylene. This can be varied by one skilled in the art to achieve a desired result. The interesting result is that the same shade is produced with 70% less dye and chemicals required to acid dye a carpet of 100% Nylon. The dyed carpet is dried using a conventional dryer but at greater efficiency since only 30% of the material (the sheath) is holding water. Backing is applied to the dyed carpet in a conventional manner. The resultant carpet appears similar to a carpet made from 100% Nylon dyed by the Nylon dye method. A noticeable brilliance of color is seen due to the fact that the color is magnified by the undyed clear core.

The savings achieved are substantial as only a portion of the yarn was made from an expensive Nylon material and only that portion was dyed using expensive dyes.

The above carpet could also be printed using a screen print method as described in Example 5 or could be multicolored using a continuous dye range with multi-color capability. Suggested uses for this carpet would be apartment homes, modular homes and private residences.

EXAMPLE 7

A LOOP PILE CARPET MANUFACTURED USING BICOMPONENT SHEATH-CORE BULKED CONTINUOUS FILAMENT CARPET YARN

Berber or large looped carpet is a desirable and popular type of carpet in the residential carpet industry.

A sheath-core yarn is melt spun using a sheath of 40% Nylon and a core of 60% polypropylene. The yarn is texturized using the bulked continuous filament carpet yarn crimping process as described in the invention. The finished BCF carpet yarn is 1500 denier in size with each filament being 25 denier. There are 60 filaments to the bundle.

A 1500 denier 60 filament 25 denier per filament bicomponent sheath-core carpet yarn was air entangled. Six BCF undyed sheath-core carpet yarns were air entangled with the same type of yarn that was previously acid dyed using the space dyed knit-de-knit nylon dye method. The resultant carpet yarn was 10,500 denier in size. A trilobal shape was used when extruding the multifilament BCF yarn. This is a preferred cross section shape when a courser texture is desired in loop carpets. One skilled in the art would choose a cross section suitable for the type of carpet desired.

This carpet yarn was tufted on a ¼ gauge loop pile tufting machine having 576 needles across a 12 foot width. The width can vary according to the need according to one skilled in the art. In this example, the sheath was 40% Nylon and the core was 60% polypropylene but could be adjusted by one skilled in the art to suit a particular type of carpet design.

The resultant carpet had seven and one half stitches to the inch lengthwise and a pile height of ½ inch. The face weight was 40.37 ounces per square yard. The carpet had specks or dots of color present due to the inclusion of the space dyed end of yarn that was air entangled with the six undyed ends of yarn. The carpet was placed on a continuous dye range and a color recipe based on the 40% Nylon sheath was formulated. The color applied was a light brown and appeared to look like carpet made from 100% Nylon that used a recipe containing 60% more dye stuff. A substantial cost savings in dye and raw materials is achieved using this technique. The sheath to core ratio can be varied according to one skilled in the art and the desired result to be achieved. The carpet produced in this example was suitable for residential Berber loop style carpet. Many variations or styles of Berber will suggest themselves to one skilled in the art. The BCF sheath-core carpet yarn of the present invention can be substituted to make any Berber style carpet that uses Nylon or a combination of Nylon and polypropylene in the face of the carpet. The size and cross section of the BCF yarn can be varied to suit the end use.

EXAMPLE 8

A COMMERCIAL LOOP PILE CARPET MANUFACTURED USING PIGMENTED COLORED BICOMPONENT SHEATH-CORE BULKED CONTINUOUS FILAMENT CARPET YARN

A bicomponent BCF yarn is prepared having a sheath of 50% Nylon that is colored during extrusion using the pigment color method and a 50% core of PET that is not colored. The BCF carpet yarn is 1344 denier and contains 48 colored sheath core filaments of 28 denier each. It is desirable but not necessary to use a high intrinsic viscosity PET that has been fully crystallized. An IV of 0.90 is preferred but IV can be as low as 0.65. The object of the present yarn would be to create a commercial carpet than is more dense that 100% nylon or 100% polypropylene.

Four separate different colored BCF carpet yarns are prepared using the above method of pigmented colored sheath with a core of clear PET. In this example the colors are brown, orange, black, and red.

These four BCF carpet yarns are combined into a single yarn that is heather in appearance and weighs 5376 denier, using a standard carpet yarn air entangling machine.

An interesting aspect of this yarn is its specific gravity. Nylon has a specific gravity of 1.14 and PET has a specific gravity of 1.38. Our combination has a specific gravity of 1.25. This allows the carpet manufacturer to make a carpet denser than 100% Nylon using a standard carpet manufacturing machine and no additional additives.

The air entangled yarn was tufted on an $\frac{1}{8}^{th}$ gauge tufting machine set to a pile height of ¼ inch with a stitch rate of 8 stitches per inch. The carpet is backed with a secondary backing in a standard carpet backing oven.

The resultant carpet is a heather loop pile carpet ready for use in heavy commercial applications such as schools, airports, office buildings etc. The carpet uses less of the expensive Nylon and associated pigment dyes and is more durable because it has a higher specific gravity than Nylon.

A 50% sheath of Nylon and a 50% core of PET was selected but anyone skilled in the art could vary the percentages of sheath to core to suit the end uses of the carpet. The cross section of the yarn filaments can be varied by one skilled in the art to suit the appearance and texture of the specific end use. PET was chosen as a core material to increase the overall specific gravity but any polymeric material suitable for BCF carpet yarn which would satisfy the end use could be chosen by one skilled in the art.

EXAMPLE 9

A COMMERCIAL PATTERNED PILE CARPET MANUFACTURED USING PIGMENTED COLORED BICOMPONENT SHEATH-CORE BULKED CONTINUOUS FILAMENT CARPET YARN

A bicomponent BCF yarn is prepared having a sheath of 50% Nylon that is colored during extrusion using the pigment color method and a 50% core of PET that is not colored. The BCF carpet yarn is 1344 denier and contains 48 colored sheath core filaments of 28 denier each. It is desirable but not necessary to use a high intrinsic viscosity PET that has been fully crystallized. The IV of 0.90 is a preferred embodiment but IV can be as low as 0.65. Steam is injected into the yarn feed tube during texturing to aid in the processing and texturing due to the fact that polyester or PET is used as the core material.

Four differently colored BCF carpet yarns are prepared using the above method of pigmented colored sheath with a core of clear PET. In this example the colors are brown, orange, black, and red.

Each individual colored yarn is twisted with six turns per inch and is plied together with a like color on a standard carpet yarn twisting and plying machine. The result is twisted two-ply solid color carpet yarn. This preferred embodiment would further process the solid colored two-ply yarn on a Superba heat setting machine resulting in two-ply heat set twisted solid colored yarns of brown, orange, black, and red.

An Axminster weaving machine is set up to weave the four colors into a pleasing cut pile patterned carpet using a ⅜ inch pile height and a 10 pitch 9 row construction. The resultant carpet is a woven durable patterned carpet suitable for use in commercial installations such as hotels, airports, office buildings, etc.

One skilled in the art could vary the pigmented sheath percentage to 25% and change the core material to uncolored olefin to greatly reduce the price of the face yarn. This yarn would then be used to weave an inexpensive patterned rug or carpet using a Belgian double face weaving machine.

EXAMPLE 10

A COMMERCIAL PATTERNED PILE CARPET MANUFACTURED USING PIGMENTED COLORED BICOMPONENT SHEATH-CORE BULKED CONTINUOUS FILAMENT CARPET YARN

Preparing the pigmented colored carpet yarn as in example 8 above and twisting and heat setting the yarns as described in example 9 the yarn is tufted on a graphics loop or cut pile tufting machine. A dense durable commercial patterned carpet is thus produced having the characteristics of a comparable carpet of 100% Nylon. One skilled in the art would vary the pigmented sheath to core or change the core materials to a less dense and less expensive material such as polypropylene to suit the end use of the carpet.

EXAMPLE 11

A STAIN PROOF CARPET MANUFACTURED USING PIGMENTED COLORED BICOMPONENT SHEATH-CORE BULKED CONTINUOUS FILAMENT CARPET YARN

A bicomponent BCF yarn is prepared having a sheath of 30% PET that is colored during extrusion using the pigment color method and a 70% core of polypropylene that is not colored. The yarn is processed by the BCF carpet yarn method and steam is used at the yarn feed tube and texturing jet instead of heated air. The BCF carpet yarn is 1344 denier and contains 48 colored sheath core filaments of 28 denier each. It is desirable but not necessary to use a high intrinsic viscosity PET that has been fully crystallized. The IV of 0.90 is a preferred embodiment but IV can be as low as 0.65.

It is well known PET cannot ordinarily be dyed in the atmosphere without the aid of a chemical carrier or be dyed at the boil using acid disperse or reactive dyes or colored by standard common food or beverage colors at standard atmospheric pressures. PET is relatively inert to color except at elevated temperatures of 275° F. and above. Since elevated temperature conditions are not available where carpet is installed stains or color such as wine, cool aid, coffee, tea, mustard, red sauces, etc., will not permanently stain the sheath of PET. The polypropylene core is impervious to the same colors and stains.

Four differently colored BCF carpet yarns are prepared using the method of pigmented colored sheath with a core of uncolored polypropylene. In this example the colors are brown, orange, black, and red.

These four BCF carpet yarns are combined using a standard carpet yarn air entangling machine into a single yarn that is now heather in appearance and weighs 5376 denier.

The combined yarn is tufted on an $\frac{1}{8}^{th}$ gauge tufting machine set to a pile height of ¼ inch with a stitch rate of 8 stitches per inch. The carpet is backed with a secondary backing in a standard carpet backing oven.

The resultant carpet is a heather loop pile carpet ready for use in light commercial applications such as office buildings and retail mall shops where the carpet is changed frequently. The carpet is more durable than 100% polypropylene because of a higher specific gravity. Therefore this product is an improved substitute for light commercial carpet. Costs of the carpet are minimized by only using a sheath of 30% PET and associated pigments to dye the PET with an undyed polypropylene core.

A 30% sheath of PET and a 70% core of polypropylene was selected but anyone skilled in the art would vary the percentages of sheath to core to suit the end uses of the carpet.

The carpet made by this example is virtually stain proof to colors and more durable versions may be constructed, for example: a sheath of 50% PET and an undyed core of 50% Nylon would provide greater resistance to heavy commercial traffic. Also a 50% Nylon colored sheath with the remaining dye sites blocked and a 50% core of PET would work well as a heavy commercial stain proof carpet.

Cleanability: Since the sheath color is applied as pigment, any attempts to remove the pigmented sheath color using standard household chemicals such as bleach, ammonia or detergents would not be effective. However those chemicals would remove any of the common household stains that may have permanently stained a 100% Nylon carpet. In the foregoing example a BCF yarn was illustrated but one skilled in the art could use the sheath-core principle to create a staple carpet yarn that would also be impervious to stains.

EXAMPLE 12

A carpet yarn is manufactured using a sheath core staple fiber composition where the sheath is 30% nylon and the core is 70% polypropylene. The staple is manufactured by extruding individual filaments of 18 denier fully drawn to 1:2.84 ratio then crimped with 7 curls to the inch and cut to staple lengths of 7.5 inches. The total of the drawn filaments from the bicomponent spin pack was 10,000 denier. The staple was spun into a 3s cotton count singles on a modified worsted spinning system. The single yarns were twisted into a two ply carpet yarn and heat set to retain the twist using a standard Sussen heat setting apparatus.

The bicomponent spun staple carpet yarn was tufted into a cut pile carpet on a $\frac{1}{8}^{th}$ gauge tufting machine and weighed 56 ounces per square yard. The carpet was dyed in a beck using a standard acid dye shade of light brown. The carpet dyed to a solid shade and used 50% less dye to achieve the shade than a carpet manufactured using 100% nylon. The carpet was backed and appeared to be similar to a carpet made from 100% nylon.

By blending of different dye affinities of this staple one skilled in the art could create a heather staple that could be spun into bulked carpet yarn and subsequently twisted and heat set into a plied yarn suitable for cut pile heather colored carpet. One skilled in the art could also use pigmented solid shades of staple and vary the sheath to core and blend white or uncolored sheath core staple to make a less expensive modern styled carpet that would cost less to manufacture than carpet made from 100% nylon staple.

EXAMPLE 13

A carpet yarn is extruded and prepared according to the invention having a 30% sheath of PET and a 70% core of olefin. The yarn is a BCF and is placed on every other needle on an $\frac{1}{8}^{th}$ gauge cut pile tufting machine. In addition, a BCF sheath core carpet yarn prepared according to the invention but containing a deep blue pigmented sheath of 30% PET and a 70% core of olefin is placed on every other needle. The carpet is tufted and appears to have a deep blue color on every other row of tufted yarns. The carpet is dyed according to the pressure beck polyester dye method at temperatures of 275° F. for one hour. The dyed carpet now is a deep blue and a light brown tweed shade. The light shade of brown did not overdye the pigmented deep blue but dyed the white PET sheath to a light brown. The core of olefin did not accept any dye as it remains undyeable using the polyester disperse pressure dye method. One skilled in the art would know that a combination of staple or Pigmented Nylon or pigmented PTT could be substituted in the example to create an acceptable and pleasing carpet.

EXAMPLE 14

A BCF yarn is prepared according to the invention that contains 60 filaments of 25 denier each filament. 45 filaments or 75% are bicomponent sheath core filaments with a sheath of 30% nylon 6 and a core of 70% olefin. 15 filaments extruded simultaneously contain 100% Nylon 6. The finished BCF carpet yarn is further processed by having it twisted with another identical end into a two ply heatset carpet yarn. The two ply yarn is tufted on an $\frac{1}{8}^{th}$ gauge tufting machine and carpet is made containing 38 oz per square yard. The carpet is piece dyed using the nylon dye formula of acid dyes for a deep green shade. The carpet is removed from the dye process and dried and the result is a two tone shade of deep greens. The sheath core yarn appears as a light tone of green while the 25% homopolymer nylon dyed a deeper shade. The filaments were evenly divided during extrusion and a pleasing heather tome resulted.

One skilled in the art would vary the percentages used in the face of the carpet to create different styles. A higher percentage of homopolymer would result in more of the carpet appearing as a deeper shade. If PET was used as a core yarn and a homopolymer of PET was used in the example, the PET would not dye using the nylon dye method and the carpet would be a deep green with 25% white undyed ends. The skilled carpet maker could also substitute many different combinations and could vary the way the carpet is dyed. Either BCF or bulked staple carpet yarn could be used in the above described example by a skilled carpet maker. Different effects would also be possible if the carpet was placed in a multicolor range or if it was printed. A further embodiment would be to use the hybrid sheath core yarn as a styling yarn for a space dye and achieve a novel effect of tone on tone in each multi-color.

EXAMPLE 15

A STAIN RESISTANT CARPET

A PET yarn modified to be resilient as Nylon and to dye at the boil using polyester disperse dye is called Polytrimethylene Terephthalate (PTT). A BCF sheath core yarn is prepared using a 40% sheath of PTT and a 60% Sheath of Olefin. 60 filaments of 25 denier each are utilized to create a carpet yarn with a total of 1500 denier. Multiple ends of this yarn is air entangled to create a carpet yarn totaling 10500 denier. The yarn is placed in every needle on a ¼ gauge loop pile tufting machine and a carpet weighing 44 ounces per square yard is manufactured. The carpet is dyed at the boil using disperse dye stuffs and is dyed to a deep shade of orange. The carpet yarn sheath accepts the disperse dye at the boil and the Polyolefin core does not dye. The result is a carpet dyed to a solid shade of deep orange. The carpet has superior stain resistance as the dye necessary to stain the carpet is not readily available in household chemicals or in foodstuffs. The carpet is economical to manufacture as only 30% of the carpet face yarn is made from expensive PTT polymer and that same 30% is presented for dyeing.

It should be understood that the foregoing description of various aspects of the present invention is representative and that in order to appreciate more fully the scope of the invention reference should be made to the appended claims.

What is claimed is:

1. A carpet whose face yarn is comprised substantially of a bulked continuous filament carpet face yarn wherein said yarn comprises primarily:

(a) a bundle of drawn and crimped bi-component filaments;

(b) each filament being of at least 18 denier and consisting essentially of an outer lengthwise sheath of a dyeable nylon material surrounding a core of a different fiber-forming polymeric material that will not dye by the same method used to dye said sheath and wherein (c) the percentages of nylon and polymeric material in combination impart (i) the properties of recovery from crushing or compression, (ii) the ability to be tufted at high speeds, (iii) the strength to resist heavy foot traffic, and (iv) good bulking properties equivalent to those of a bulked continuous filament carpet face yarn consisting of 100% nylon.

2. The carpet according to claim 1 wherein said sheath consists essentially of a pigmented nylon.

3. The carpet according to claim 2 wherein said core is of a pigmented polymeric material.

4. A carpet whose face yarn is comprised substantially of a bulked staple carpet face yarn wherein said yarn comprises primarily:

(a) a bundle of drawn and crimped bi-component filaments;

(b) each filament being of at least 18 denier and consisting essentially of an outer lengthwise sheath of a dyeable nylon material surrounding a core of a different fiber-forming polymeric material that will not dye by the same method used to dye the sheath, and wherein (c) the percentages of nylon and fiber-forming polymeric material in combination impart (i) the properties of recovery from crushing or compression, (ii) the ability to be tufted at high speeds, (iii) the strength to resist heavy foot traffic, and (iv) good bulking properties equivalent to those of a bulked staple carpet face yarn consisting of 100 nylon.

5. The carpet according to claim 4 wherein said sheath consists essentially of a pigmented nylon.

6. The carpet according to claim 5 wherein said core is of a pigmented polymeric material.

* * * * *